US005319341A

United States Patent [19]

Bisbee et al.

[11] Patent Number: 5,319,341

[45] Date of Patent: Jun. 7, 1994

[54] CORE SUPPORT BLOCKING FOR TOROIDAL TRANSFORMERS

[75] Inventors: Phillip I. Bisbee; Eric S. Richardson, both of Versailles; Stephen D. Smith, Lawrenceburg, all of Ky.

[73] Assignee: Kuhlman Electric Corporation, Versailles, Ky.

[21] Appl. No.: 970,713

[22] Filed: Nov. 3, 1992

[51] Int. Cl.[5] ..... H01F 15/02

[52] U.S. Cl. ..... 336/67; 336/65; 336/229

[58] Field of Search ..... 336/65, 67, 68, 199, 336/207, 229

[56] References Cited

U.S. PATENT DOCUMENTS

| | | | |
|---|---|---|---|
| 1,577,794 | 3/1926 | Elliott | 336/67 X |
| 2,382,199 | 8/1945 | Brink | 336/67 |
| 2,511,230 | 6/1950 | Wald | 336/67 X |
| 3,027,526 | 3/1962 | Patka et al. | 336/229 X |
| 3,504,319 | 3/1970 | Leonard . | |
| 4,263,479 | 4/1981 | Lange et al. | 336/92 X |
| 4,833,436 | 5/1989 | Martin et al. | 336/229 X |

*Primary Examiner*—Leo P. Picard
*Assistant Examiner*—L. Thomas
*Attorney, Agent, or Firm*—Townsend & Townsend Khourie & Crew

[57] ABSTRACT

Core support blockings (10, 12) used to support a toroidal transformer (2) within a transformer housing (4) includes a pie-shaped body (28) having a second end (32) secured to the transformer core (14) using an adhesive (41). The body has adhesive flow regions, typically countersunk holes (42) passing through mounting flanges (38, 40) extending laterally adjacent the second end of the body. Electrical windings (26) can be wound on first end of the mounting flanges so to help mechanically secure the body to the core. A mounting stud (46), or other mounting element, is used to secure the transformer to a support bracket (8). Together the support bracket and core support blockings are used to support the transformer within the transformer housing.

17 Claims, 3 Drawing Sheets

CORE SUPPORT BLOCKING FOR TOROIDAL TRANSFORMERS

BACKGROUND OF THE INVENTION

Toroidal transformer assemblies include, broadly, a transformer, a transformer container or housing and mounting hardware for supporting the transformer within the housing. The transformer includes a cylindrical core, made of magnetic steel, and various electrical coils wound around the core and passing through the eye of the core.

Electrical toroidal distribution transformers, typically having ratings of 10 to 50 Kva, are relatively large and quite heavy, weighing from about 40 kg. for 10 Kva transformers to about 100 kg. for 50 Kva transformers. Also, distribution transformers create heat and a certain amount of vibration during use and must withstand movement during handling and installation. Such transformers thus require sturdy mounting hardware. However, the mounting hardware should not be such to affect the electrical, magnetic or thermal performance of the transformer.

Another problem associated with the manufacture of distribution-type electrical transformers relates to size variation. First, different size transformers with their different Kva and voltage ratings must be accommodated, often using the same size transformer housing. Second, due to core variations and the necessarily imperfect windings associated with toroidal transformers, the dimensions of transformers having the same nominal rating will vary somewhat.

One type of transformer mounting hardware is shown in U.S. Pat. No. 4,833,436 for Formed Metal Core Blocking, issued May 23, 1989, the disclosure of which is incorporated by reference. It uses U-shaped steel stampings which generally circumscribe the core and also extend into the interior of the core. This design, while effective at supporting the transformer, is not very adaptable to transformers having different inside and outside diameters. Also, the presence of support structure within the eye of the transformer hinders the flow of cooling fluid through the core.

SUMMARY OF THE INVENTION

The present invention is directed to core support blockings, and an associated support bracket, used to support a toroidal distribution transformer within a transformer housing. The core support blockings are secured to the end surfaces of the core using an adhesive to eliminate any effects on the integrity of the core.

One of the main aspects of the invention is the recognition that the core blockings for a toroidal type transformer should not extend into the eye of the transformer so as not to restrict the placement of windings in the eye or impede the convective currents of cooling oil during use. To achieve this goal, the core support blockings are designed to be securely affixed to the core without needing any part of the blockings or support fixtures to extend into the eye of the transformer. Since it is not necessary for the radially inner end of the blockings to extend to the boundary of the transformer eye, the blockings can be used with a range of sizes of transformers. The support bracket is also designed to be used with a variety of sizes of toroidal transformers to further minimize the cost associated with stocking parts for each different size transformer.

The core support blockings each includes a pie-shaped body having a surface which is secured to the core of the transformer using adhesive. The body has adhesive flow regions, typically countersunk holes passing through mounting flanges extending laterally adjacent the bottom of the body. The shape, perforations and details of the adhered surface provide for a mechanical joint as well as an adhesive bond. The mounting flanges, lying adjacent the end surfaces of the transformer core, are configured so that one or more of the electrical windings can be wound over the mounting flanges. Doing so helps to mechanically secure the core support blockings to the core. A mounting element, such as a threaded mounting stud extending from the radially outer end of the body, is used to secure the transformer to the support bracket. Together the support bracket and core support blockings are used to support the transformer within the transformer housing.

Each core support blocking preferably includes a radially extending undercut region extending from the inner end to the outer end. This allows for the passage of wires to a position exterior of the windings where they can be secured to other windings or to external leads. One or more of the core support blockings can include a cutout region extending between the top and bottom of the body of the blocking to permit passage of the finished transformer leads away from the transformer without interfering with the placement of other windings.

The core support blockings are preferably mounted to first and second vertical legs of the support bracket. The support bracket also includes a lower support arm and an upper support arm secured to the ends of the vertical legs to make a rectangular support bracket surrounding the transformer. The transformer support assembly, that is the support bracket and the core blockings, constitute the mounting hardware used to support the transformer within the housing. The housing is typically a cylindrical container in which the transformer is immersed in a transformer oil.

Other features and advantages of the invention will appear from the following description in which the preferred embodiment has been set forth in detail in conjunction with the accompanying drawings.

DESCRIPTION OF THE PREFERRED EMBODIMENT

Figure 1:
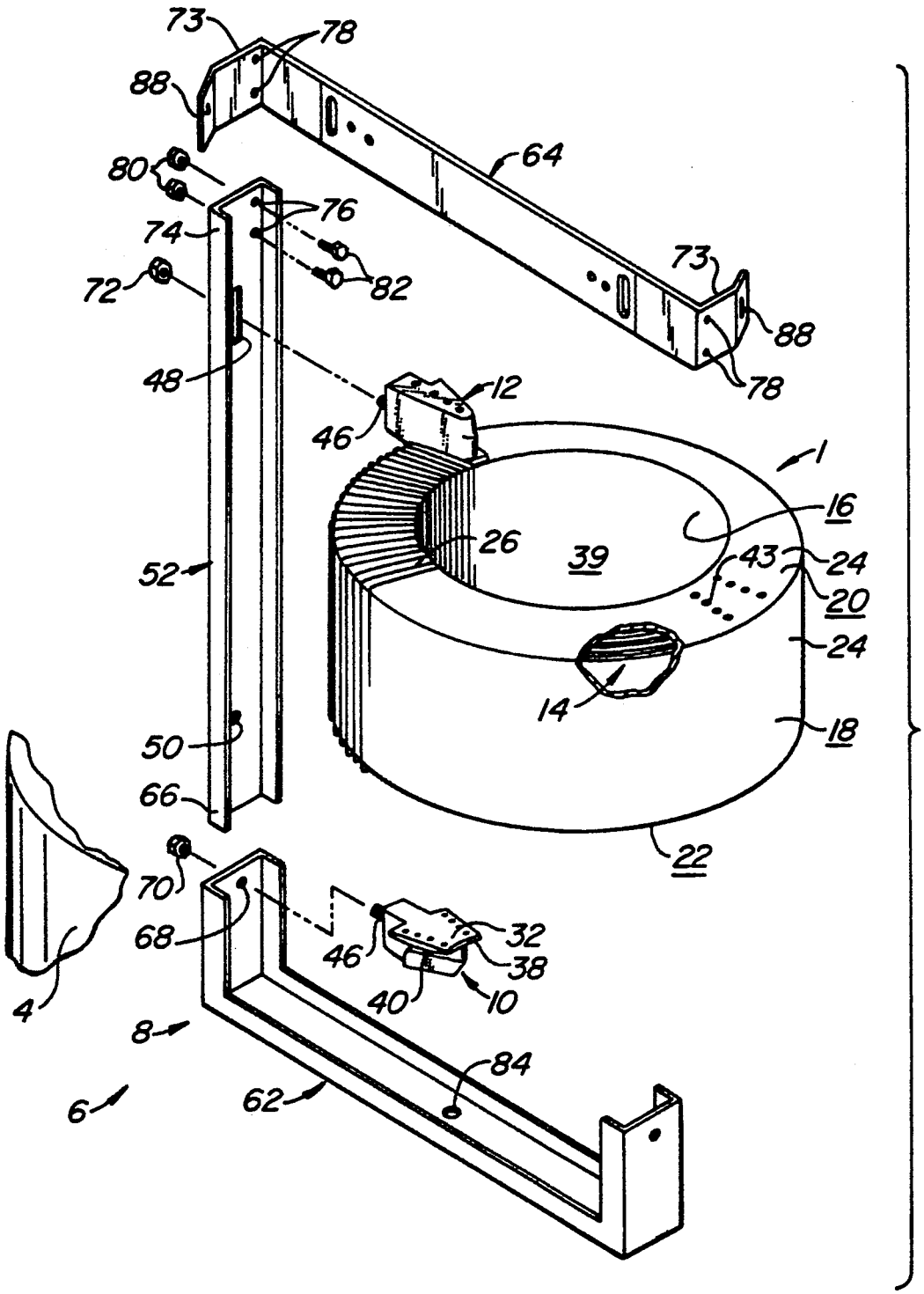
FIG. 1 is an exploded isometric view of a partially wound toroidal core and coil assembly, a distribution transformer support assembly, and a partial view of the container within which the finished transformer, shown in FIG. 2, and support assembly are housed.
Figure 2:
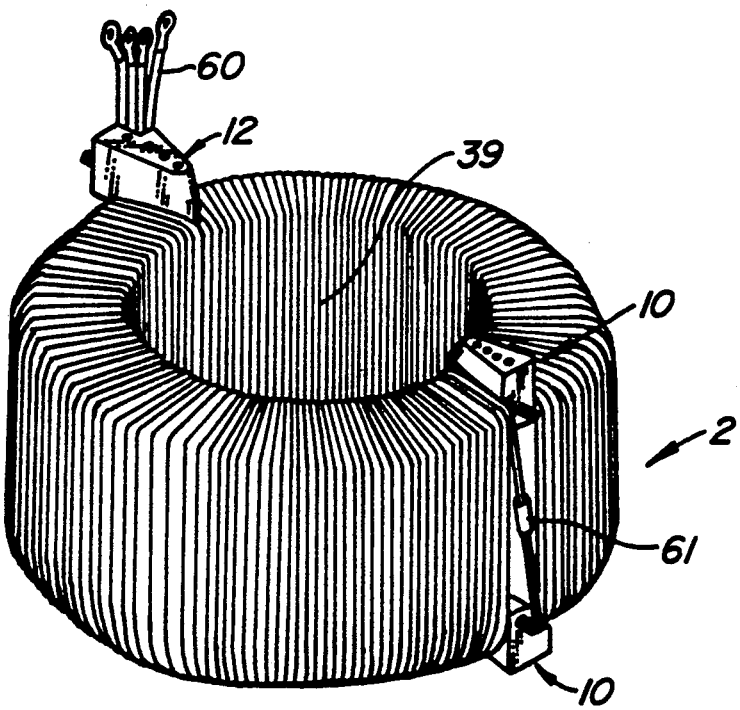
FIG. 2 is a perspective view showing a completely assembled transformer with core support blocking ready to be mounted to the support bracket.
Figure 3:
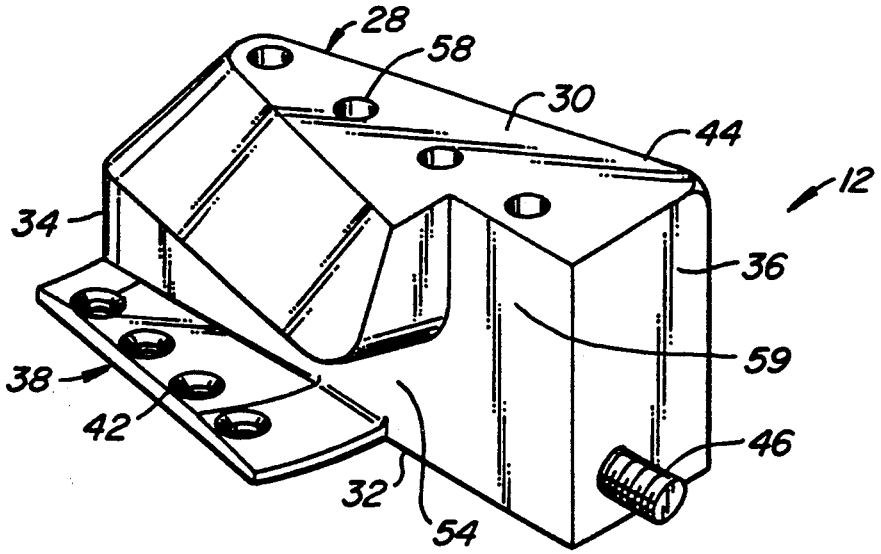
FIG. 3 is an enlarged perspective view of one type of the core support blockings of FIG. 1.
Figure 6:
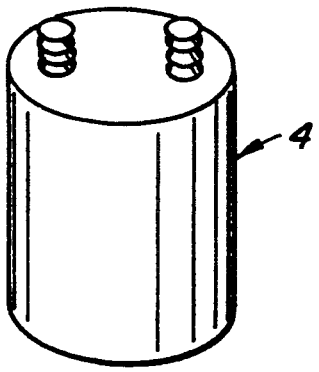
FIG. 6 is a simplified view of an assembled transformer assembly.

FIG. 1 illustrates a partially wound distribution-type toroidal core and coil assembly 1 which, after being completed as shown in FIG. 2 as transformer 2, is housed within a cylindrical tank or container 4 (see also FIG. 6) by a distribution transformer support assembly 6. Assembly 6 includes a support bracket 8 and core support blockings 10, 12. With this embodiment, three core support blockings 10 are used and one core support blocking 12 is used. Blockings 10, 12 are very similar so that blocking 10 will be discussed first and with reference to FIG. 3.

Transformer 2 includes a wound transformer core 14 having inner and outer cylindrical surfaces 16, 18 and end surfaces 20, 22. Surfaces 16, 18, 20, 22 are preferably covered by transformer pressboard material 24. Electrical windings 26 are then wound about pressboard material-covered core 14 to create transformer 2. Material 24 acts as an electrical insulator, helps prevent nicking and scratching of windings 26 and also helps to protect the wound transformer core material. This is especially helpful when core 14 is wound amorphous magnetic steel material which has a tendency to become somewhat brittle after being annealed for transformer use. This method is disclosed in more detail in U.S. patent application Ser. No. 07/820,708, filed Jan. 14, 1992, for Transformer Core and Method for Finishing, the disclosure of which is incorporated by reference for all purposes.

Figure 4:
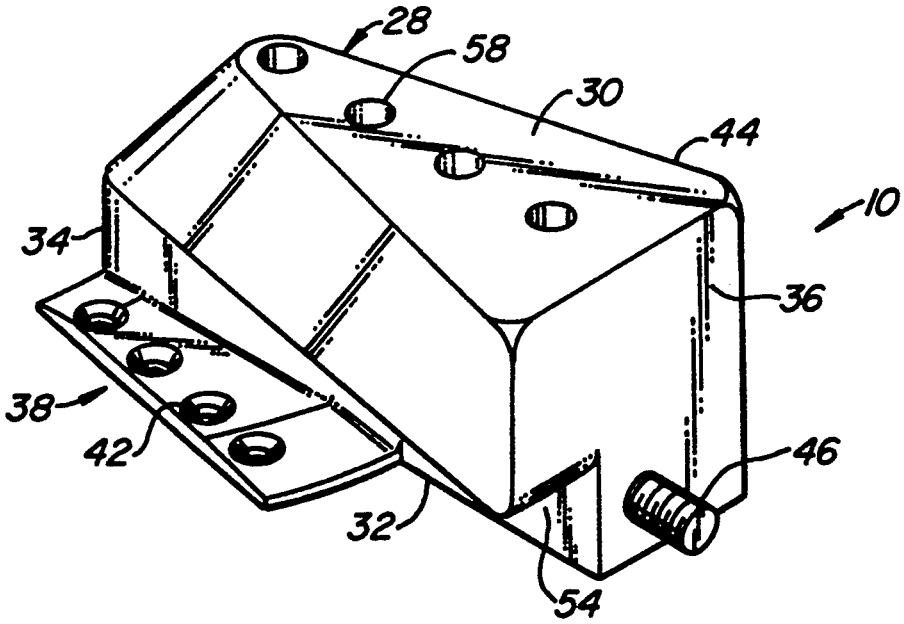
FIG. 4 is a perspective view of a second type of the core support blockings of FIG. 1 including a vertically extending cutout region for the passage of external leads.

Referring primarily to FIG. 4, blocking 10 is shown to include a pie- or wedge-shaped body 28 having a first end 30, a second end 32, a narrow, radially inner end 34 and a wider, radially outer end 36. Body 28 also includes a pair of mounting flanges 38, 40 extending laterally adjacent second end 32 and extending between inner and outer ends 34, 36. The radial length of mounting flanges 38, 40 is no greater than the radial dimension of transformer 2, that is, the distance between inner and outer surfaces 16, 18. Core blockings 10, 12 can be used with different size transformers 2 so long as blockings 10, 12 do not substantially pass inner circumferential surface 16. If blockings 10, 12 would extend into eye region 39 of wound transformer 2, shown in FIG. 2, the blockings would reduce the space available for the windings and would likely hinder the convective flow of transformer oil up through the eye region of the transformer.

Figure 5:
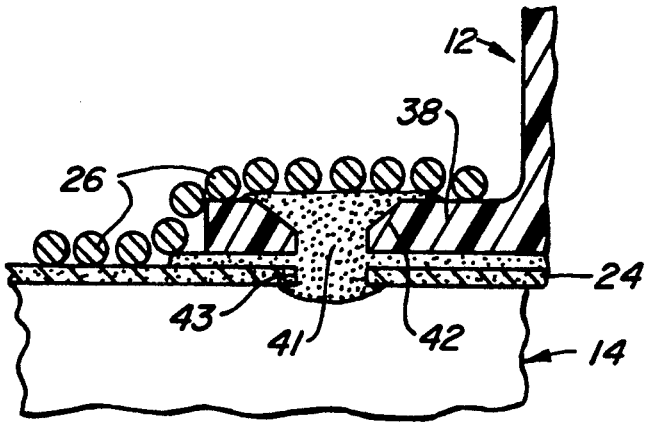
FIG. 5 is an enlarged partial cross-sectional view of a portion of a core support blocking illustrating, in exaggerated form, an adhesive creating both an adhesive bond and a mechanical joint and a layer of windings over the mounting flange.

Mounting flanges 38, 40 have a series of countersunk, that is inwardly tapering, holes 42 formed therein. Holes 42 aid in securing blockings 10, 12 to end surfaces 20, 22 of transformer 12. Securement is accomplished using an adhesive 41, preferably an epoxy compatible with the surfaces to be joined. See FIG. 5. Extra adhesive 41 passes up through holes 42 to provide increased bonding force than would be available using only flat surfaces. Other types of adhesive accepting regions, such as dovetailed shape slots formed in second end 32, or outwardly-opening U-shaped openings formed through flanges 38, 40, could be used as well. As shown in FIG. 1, holes 43 are formed in the pressboard 24 covering end surfaces 20, 22 at locations beneath blockings 10, 12 and aligned with holes 42. Holes 43 permit adhesive 41 to contact and adhere to the ends of the metal core 14 in addition to the pressboard. As suggested in FIG. 5, some adhesive 41 flows in between the layers of material constituting the wound core 14.

A portion 44 of body 28 adjacent outer end 36 is sized to extend past outer cylindrical surface 18 of core 14 when blockings 10, 12 are mounted to core 14. This permits space for a buildup of windings 26 to be created without interfering with mounting transformer to support bracket 8. This mounting is accomplished using threaded mounting studs 46 which pass through appropriate openings 48, 50 in the vertical legs 52 of support bracket 8 and through openings 68 in lower support arm 62. (Only one of the two vertical legs 52 is shown in FIG. 1.) Openings 48 are preferably elongate slots to accommodate size variations among transformers having the same nominal Kva rating. Different sets of slots 48 can be formed in vertical legs 52 to accommodate different sizes of transformers 2. When different sizes of tanks 4 are used, lower and upper support arms 62, 64 can be provided in different lengths according to the diameter of container 4. However, regardless of the height of transformer 2, the same blocking 10, 12 can be used for transformer 2 over a range of outer and inner diameters since inner end 34 need not reach inner circumferential surface 16 of core 14.

As can be seen from FIG. 1, windings 26 pass over mounting flanges 38, 40 to help mechanically secure blockings 10, 12 to core 14. Each blocking 10 also includes an undercut region 54 extending between inner and outer ends 34, 36 adjacent mounting flange 38. Region 54 is used to provide an exit path for the terminal ends of various windings 26 which are spliced together at 61 to create interlaced coil sections, as is conventional, or secured together to create finished leads 60, as shown in FIG. 2.

Blockings 10, 12 also include a number of support holes 58 formed in first end 30. Holes 58 are used in mounting core 14 to a coil winding machine during coil winding operations.

A primary difference between blockings 10 and blocking 12 is that blocking 12 includes a generally vertically extending cutout region 59 extending between first end 30 and second end 32 and intersecting undercut region 54 at outer end 36. Cutout region 59 is used to permit finished terminal leads 60, shown in FIG. 2, to exit vertically from between vertical leg 52 and transformer 2.

Support bracket 8, in addition to vertical legs 52, includes a generally U-shaped lower support arm 62 and an upper support arm 64. Lower support arm 62 is secured to the lower ends 66 of vertical legs 52 through the engagement of mounting stud 46 through a mounting hole 68 formed at either end of lower support arm 62 with correspondingly positioned holes 50 in legs 52 using nuts 70 to hold the parts together. Similarly, mounting studs 46 of blockings 10, 12 are inserted through slots 48 in vertical legs 52 and are secured in place using nuts 72. The outer ends 73 of upper support arm 64 are positioned outside of the upper ends 74 of vertical legs 52. Upper ends 74 include a pair of holes 76 which are aligned with similarly positioned holes 78 formed at ends 73 of upper support arm 64. Nuts and bolts 80, 82 are used to secure ends 73, 74 together. Alternatively, thread forming screws can be used instead of nuts and bolts 80, 82.

Insulating kraft transformer paper is typically used between vertical legs 52 and transformer 2 to help prevent shorting of windings 26 against support bracket 8. Such insulation is, however, not shown in the figures for clarity.

In use, core 14 has one blocking 10 and one blocking 12 secured to end surface 20 and two blockings 10 secured to surface 22. After adhesive 41 has cured sufficiently, core 14 and blockings 10, 12 therewith can be mounted to a conventional coil winding machine to have windings 26 wound onto core 14 to create transformer 2. In doing so, certain turns of windings 26 are wound on top of mounting flanges 38, 40 to provide mechanical securement of core blockings 10, 12 to core 14. After being wound, transformer 2 is secured to vertical legs 52 and lower support arm 62. Upper support arm 64 is then secured to upper end 74 of vertical legs 52. The combination of support assembly 6, that is support bracket 8 and core blockings 10, 12, together with transformer 2 is then lowered into container 4. Lower support arm 62 preferably has a centrally located hole 84 used to guide and center support bracket 8 within container 4. Container 4 has an upwardly extending, generally conical projection (not shown) at the center of the bottom of container 4 which engages hole 84. Thus, transformer 2 rests centered on the bottom of container 4. Transformer 2 is stabilized inside container 4 by fastening the ends 86 of upper support arm 64 to the inside walls of container 4 using a fastener (not shown) which engages holes 88 at ends 73 of upper support arm 64.

Modification and variation can be made to the disclosed embodiment without departing from the subject of the invention as defined in the following claims. For example, while core support blockings 10, 12 are made of a reinforced plastic resin, such as Valox 414 made by General Electric Co., other materials, preferably not electrically conductive, can also be used. Instead of using mounting stud 46, other types of connection elements, such as clips, hanging brackets, and so forth, could be used as well.

What is claimed is:

1. Core support blocking, for use with toroidal transformers of the type including a hollow cylindrical core, made of magnetic material, having inner and outer cylindrical surfaces and end surfaces, and electrical windings wound about the core, the inner cylindrical surface defining an eye region, the core support blocking comprising:

a body having a first end, a second end, a radially inner end and a radially outer end;

the body configured to lie against at least one of the end surfaces to permit the body to be secured to the at least one of the end surfaces by an adhesive;

the body being sized and positioned so that the body does not extend substantially into the eye region; and a mounting element associated with the body used to support the transformer through the core support blocking.

2. The core support blocking of claim 1 wherein the body is pie-shaped with the inner end being narrower than the outer end.

3. The core support blocking of claim 1 wherein the body includes an undercut region extending from the inner end to proximate the outer end.

4. The core support blocking of claim 3 wherein the body includes a cutout region, intersecting the undercut region, at the outer end extending between the first end and the second end.

5. The core support blocking of claim 2 wherein the body includes an undercut region extending from said radially inner end to proximate said radially outer end, said undercut region providing a wire passageway between the inner and outer ends.

6. The core support blocking of claim 5 wherein the body includes a cutout region, intersecting the undercut region, said cutout region providing a wire lead passageway between the first end and the second end.

7. The core support blocking of claim 1 wherein the body includes a mounting flange extending away from the second end, the flange being configured to permit one or more of the windings to lie on first end of the flange so to enhance the securement of the body to the core.

8. The core support blocking of claim 7 wherein the body includes an adhesive flow region for enhanced bonding of the body to the core.

9. The core support blocking of claim 8, wherein the adhesive flow region includes an opening passing through the flange.

10. The core support blocking of claim 9 including a plurality of said circular openings.

11. The core support blocking of claim 9 wherein the circular opening includes a conical surface.

12. The core support blocking of claim 7 wherein the body includes first and second of said mounting flanges.

13. The core support blocking of claim 1 wherein the mounting element includes a threaded stud extending from the outer end.

14. A toroidal distribution transformer support assembly, for use with toroidal transformers of the type including a hollow cylindrical core, having inner and outer cylindrical surfaces and end surfaces, and electrical windings wound about the core, the inner cylindrical surface defining an eye region, the support assembly comprising:

a plurality of core support blockings each including:

a body having a first end, a second end, a radially inner end and a radially outer end;

the body including a mounting flange extending away from the second end and configured to lie against at least one of the end surfaces to permit the body to be secured to the at least one of the end surfaces by an adhesive;

the body being sized and positioned so that the eye region is substantially free of said body;

the flange being configured to permit one or more of the windings to lie on first end of the flange so to enhance the securement of the body to the core; and a mounting element associated with the body used to support the transformer through the core support blocking; and a support bracket comprising:

first and second legs positioned adjacent the radially outer ends of said core support blockings;

securement elements, securable to the mounting elements, used to secure the core support blockings to the first and second legs;

a first support arm securable to the first and second legs and positionable opposite one end surface of the transformer; and a second support arm securable to the first and second legs and positionable opposite to other end surface of the transformer.

15. The support assembly of claim 14 wherein:

the body is pie-shaped with the radially inner end being narrower than the radially outer end; and the body includes an adhesive flow opening passing through the flange; and further comprising:

means for providing intersecting wire lead pathways between said inner and outer ends and between said second end and said first end at said outer end.

16. A toroidal distribution transformer support, for use with toroidal transformers of the type including a hollow cylindrical core, having inner and outer cylindrical surfaces and end surfaces, and electrical windings wound about the core, the inner cylindrical surface defining an eye region, the support assembly comprising:

a plurality of core support blockings each including:

a body having a first end, a second end, a radially inner end and a radially outer end;

the body including a mounting flange extending away from the second end and configured to lie against at least one of the end surfaces to permit the body to be secured to the at least one of the end surfaces by an adhesive;

the body being sized and positioned so that the eye region is substantially free of said body;

the flange being configured to permit one or more of the windings to lie on top of the flange so to enhance the securement of the body to the core; and a mounting element associated with the body used to support the transformer through the core support blocking.

17. The support of claim 16 wherein:

the body is pie-shaped with the radially inner end being narrower than the radially outer end; and the body includes an adhesive flow opening passing through the flange; and further comprising:

means for providing intersecting wire lead pathways between said inner and outer ends and between said second end and said first end at said outer end.

* * * * *